United States Patent [19]

Paveliev et al.

[11] Patent Number: 4,934,466

[45] Date of Patent: Jun. 19, 1990

[54] DEVICE FOR BOREHOLE HYDRAULIC MINING

[76] Inventors: Vladimir F. Paveliev, ulitsa Volgina, 8 kv. 410; Grigory J. Abramov, ulitsa Udaltsova, 14, kv. 44; Nikolai I. Babichev, Bogorodsky val, 6, korpus 2, kv. 432; Viktor A. Dmitriev, Moskvorechie, 8, kv. 410, all of, Moscow, U.S.S.R.

[21] Appl. No.: 314,556

[22] Filed: Feb. 23, 1989

[51] Int. Cl.[5] ..... E21B 21/12

[52] U.S. Cl. ..... 175/102; 175/215; 175/324

[58] Field of Search ..... 175/64, 67, 215, 324, 175/102, 424; 299/17

[56] References Cited

U.S. PATENT DOCUMENTS

| | | | |
|---|---|---|---|
| 2,018,285 | 10/1935 | Schweitzer et al. | 175/67 |
| 3,951,457 | 4/1976 | Redford | 299/77 |
| 4,134,619 | 1/1979 | Bunnelle | 175/215 |
| 4,275,926 | 6/1981 | Hodges | 175/215 |
| 4,296,970 | 10/1981 | Hodges | 175/215 |
| 4,415,206 | 11/1983 | Hodges | 175/215 |
| 4,718,728 | 1/1988 | Hodges | 299/17 |

FOREIGN PATENT DOCUMENTS

| | | |
|---|---|---|
| 1191584 | 11/1985 | U.S.S.R. . |
| 1198205 | 12/1985 | U.S.S.R. . |

*Primary Examiner*—Bruce M. Kisliuk

*Attorney, Agent, or Firm*—Lilling & Greenspan

[57] ABSTRACT

A device for borehole hydraulic mining includes a pipeline for delivering fluid into the hole accommodated inside a pipeline for bringing pulp to the surface and featuring a constant inside diameter along the entire length of this pipeline. The pipeline for delivering fluid into the hole carries a hydraulic jet. The device also has a hydraulic elevator with a fluid and pulp mixing chamber secured to the lower end of the pipeline for bringing pulp to the surface, and a nozzle secured to the lower end of the pipeline for delivering fluid into the hole. The fluid and pulp mixing chamber and the nozzle of the hydraulic elevator enclose the pipeline for drilling fluid into the hole with clearances allowed.

4 Claims, 1 Drawing Sheet

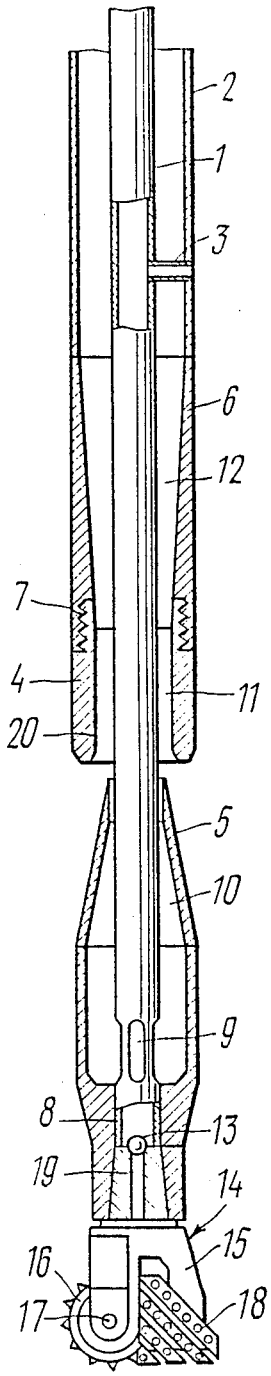
2
1
3
6
12
7
4
11
20
5
10
9
8
13
19
14
15
16
17
18

DEVICE FOR BOREHOLE HYDRAULIC MINING

BACKGROUND OF THE INVENTION

1. Field of the Invention

The invention relates to mining, and more particularly it relates to devices for borehole hydraulic mining.

The invention can find application in mining of such minerals as peat, phosphorite, building materials (sand, clay), bauxites, oxidized iron and manganese ores, coal (lignite), development of rare and radioactive metal deposits, as well as placer deposits of gold, diamond, amber, development of submarine deposits, including those in the World Ocean shelf zone, cutting of underground openings of different configuration in barren rocks for laying foundations, draining groundwater, and making underground storages for liquid and gaseous products.

2. Description of the Prior Art

There is known a device for borehole hydraulic mining (SU, A, 1,198,205), comprising a pipeline for delivering water into the hole accommodated inside the pulp lifting pipeline. Secured to the lower end of the pipeline for delivering water into the hole is a hydraulic giant which is in fact a stem with hydraulic jets secured to its lower end. The device also comprises a hydraulic elevator with a water and pulp mixing chamber, and a nozzle secured to the lower end of the pulp lifting pipeline and enclosing the hydraulic giant stem. The hydraulic giant casing is provided with holes whereby the inner space of the hydraulic giant communicates with the inner space of the hydraulic elevator nozzle. Water enters the hydraulic giant under pressure, wherefrom it flows through the hydraulic jets into rocks for mineral disintegration. Part of the water flow enters the hydraulic elevator through the holes provided in the hydraulic giant casing. A water jet emerging from the annular nozzle of the hydraulic elevator and flowing into the water and pulp mixing chamber has an inner space with a rarefaction zone into which the pulp is drawn.

The pulp is drawn from the face of the hydraulic elevator, which results in lower mining efficiency.

Such a constructional arrangement of the device makes it impossible to use a drilling bit required in mining of unconsolidated rocks prone to caving.

There is also known a device for borehole hydraulic mining (SU, A, 1,191,584) comprising a pipeline for delivering water into the hole concentric within which is a pipeline for bringing pulp to the surface. Secured to the lower end of the pipeline for delivering water into the hole is a hydraulic jet hydraulically associated with this pipeline. The device also comprises a hydraulic elevator with a water and pulp mixing chamber secured to the lower end of the pipeline for bringing pulp to the surface and a nozzle secured to the lower end of the pipeline for delivering water into the hole by means of water supply pipes whose one end is secured to the end of the pipeline for for delivering water into the hole and the other end, to the nozzle body. The hydraulic elevator nozzle is positioned below the water and pulp mixing chamber coaxially therewith. The inner space of the hydraulic elevator nozzle is hydraulically associated with the inner space of the pipeline for delivering water into the hole through the ports between the water supply pipes of the pipeline for delivering liquid into the hole.

Part of the water enters the hydraulic jet under pressure, after which it flows into rocks, wherein a mineral is disintegrated and a pulp is formed. The other part of the water flows into the hydraulic elevator nozzle through the water supply pipes. At the inlet to the water and pulp mixing chamber there is formed a rarefaction zone into which the pulp is drawn. Should the need arise to deepen the hole in unconsolidated rocks, use is made of drilling bits secured to the lower end of the pipeline for delivering water into the hole. In the process of hydraulic mining following hole deepening when the drilling bit is not used, water keeps entering the flushing ports of the drilling bit, thereby facilitating water leakage and increasing power expenditure.

The water supply pipes prevent the pulp from entering the water and pulp mixing chamber of the hydraulic elevator, thereby decreasing an active zone of drawing the pulp into the water and pulp mixing chamber of the hydraulic elevator and affecting hydraulic mining efficiency.

In the course of drilling, a torque is imparted to the drilling bit by means of the water supply pipes which are positioned within a certain distance from the device rotation axis and are subject to bending. In the event of large drilling bit torques, the water supply pipes may break down.

Since the inner surface of the pipeline for delivering water into the hole is different in diameter, the hydraulic resistance of the pipeline increases, thus resulting in higher power expenditure.

In cases where some abrasive material, say, quartz sand is involved, the working surfaces are subject to excessive wear. This primarily applies to the casing of the water and pulp mixing chamber whose repair involves welding, and this results in idle time of the device.

SUMMARY OF THE INVENTION

It is an object of the present invention to provide a decrease in power expenditure, an increase in hydraulic mining efficiency, and enhancement of operating reliability of the device.

The essence of the invention resides in a device for borehole hydraulic mining, comprising pipelines for delivering fluid into the hole and bringing pulp to the surface positioned concentric to each other, a hydraulic jet secured to the pipeline for delivering fluid into the hole and hydraulically associated with the pipeline, a hydraulic elevator comprising a fluid and pulp mixing chamber secured to the lower end of the pipeline for bringing pulp to the surface, and a nozzle secured to the lower end of the pipeline for delivering fluid into the hole below the fluid and pulp mixing chamber coaxially therewith, the inner space of the nozzle of the hydraulic elevator being hydraulically associated with the inner space of the pipeline for delivering fluid into the hole through ports provided in the side wall of the pipeline for delivering fluid into the hole. According to the invention, the pipeline for delivering fluid into the hole is accommodated inside the pipeline for bringing pulp to the surface and enclosed with the fluid and pulp mixing chamber and the nozzle of the hydraulic elevator so that clearances are allowed, and the inside diameter of the pipeline for delivering fluid into the hole is made constant along the entire length of this pipeline.

It is expedient that the inner surface of the cylindrical wall of the fluid and pulp mixing chamber of the hydraulic elevator be made of some wear-resistant material to ensure higher operating reliability of the device in borehole hydraulic mining.

It is also expedient that the fluid and pulp mixing chamber be secured to the lower end of the pipeline for bringing pulp to the surface so that it can be removed to further enhance operating reliability of the device in borehole hydraulic mining.

Realization of the present invention makes it possible to reduce power expenditure for delivering fluid into the hole under pressure through controlling delivery of fluid to the flushing ports of the drilling bit positioned at the lower end of the pipeline for delivering fluid into the hole, and also through decreasing hydraulic resistance of the pipeline for delivering fluid into the hole.

The constructional arrangement of the pipeline for for delivering fluid into the hole increases the torque imparted to the drilling bit, which facilitates penetration of the device into the hole.

Brief Description of the Drawing

In what follows the present invention will now be disclosed in a detailed description of the device for borehole hydraulic mining, specific embodiments thereof and the drawing, FIG. 1, which is a longitudinal section view of the device for borehole hydraulic mining, according to the invention.

Description of the Preferred Embodiments

The device for borehole hydraulic mining includes a pipeline 1 (FIG. 1) for delivering fluid into the hole connected with a pumping station (not shown) on the surface. The pipeline 1 is accommodated inside a pipeline 2 for bringing pulp to the surface. The pipelines 1, 2 for delivering fluid into the hole and bringing pulp to the surface are arranged concentric to to each other.

Water with chemical and mechanical admixtures, acid or alkali can be used as a borehole fluid.

The lower part of the pipeline 1 for delivering fluid into the hole carries a hydraulic jet 3 whose inlet end is welded on to the side wall of the pipeline 1 for delivering fluid into the hole and the outlet end, to the side wall of the pipeline 2 for bringing pulp to the surface. The hydraulic jet serves to connect hydraulically the pipeline 1 with the surrounding medium. The device also comprises a hydraulic elevator incorporating a fluid and pulp mixing chamber 4 and a nozzle 5 positioned below the chamber. The fluid and pulp mixing chamber 4 of the hydraulic elevator is secured to the lower end of a diffuser 6 rigidly fixed to the lower end of the pipeline 2 by means of a threaded joint 7 so that it can be removed. The nozzle 5 of the hydraulic elevator is secured to the lower end of the pipeline 1 by means of a threaded joint 8. The inner space of the nozzle 5 of the hydraulic elevator is hydraulically associated with the inner space of the pipeline 1 for delivering fluid into the hole through ports 9 provides in the side wall of the pipeline 1. The fluid and pulp mixing chamber 4, the nozzle 5 of the hydraulic elevator and the diffuser 6 enclose the pipeline 1 for delivering fluid into the hole with annular clearances 10,11,12 allowed. The pipeline 1 for delivering fluid into the hole features a constant inside diameter along the entire length of this pipeline 1 to ensure easy passage of a metal ball 13 in the inner space of the pipeline 1.

Secured to the lower end of the pipeline 1 for delivering fluid into the hole is a drilling bit 14 whose body 15 mounts taper rock cutting elements 16 positioned so that they can rotate about axes 17. The lateral surface (roll surface) of the rock cutting elements 16 carries hard-alloy tongues 18. The body 15 of the drilling bit 14 is provided with a flushing port 19 whose diameter is less than that of the ball 13.

An inner surface 20 of the fluid and pulp mixing chamber 4 is reinforced with some material, say, tungsten carbide, to improve the wear resistance of the inner surface 20.

The device for borehole hydraulic mining operates as follows.

Water is delivered under pressure through the pipeline 1 (FIG. 1). About one-third of the water enters the hydraulic jet 3 and then flows as a high-pressure jet into the rocks for hydraulic washout of minerals. The remaining portion of water flows through the pipeline 1 for delivering fluid into the hole into the inner space of the hydraulic elevator nozzle 5 through the ports 9 of the pipeline 1 and then enters as a high-pressure jet the fluid and pulp mixing chamber 4 of the hydraulic elevator through the clearance 10. As this occurs, a rarefaction zone is formed in the near-jet area, whereby the pulp resulting from mineral washout is drawn into the fluid and pulp mixing chamber 4 of the hydraulic elevator.

Thereupon the pulp is brought to the surface via the diffuser 6 through the pipeline 2.

The active zone of drawing the pulp into the chamber 4 of the hydraulic elevator is cylindrical in shape and the active zone sector is 360°, which ensures that the pulp is vigorously drawn into the fluid and pulp mixing chamber 4. As a result, hydraulic mining efficiency is increased.

With the pipeline 1 for delivering fluid into the hole positioned inside the pipeline 2 for bringing pulp to the surface, there is an increase in the lateral surface of the water jet emerging from the hydraulic jet 3. The ejecting capacity of the hydraulic elevator is also increased, thereby contributing to hydraulic mining efficiency.

Should the need arise to deepen the hole, penetration of the device into the hole is accomplished with the aid of the drilling bit 14, water being delivered to the hole bottom through its flushing port 19. The rock cutting elements 16 of the drilling bit 14 are cooled and disintegration products are brought to the surface. To prevent water leakage through the flushing port 19 of the drilling bit 14, a metal ball 13 is lowered into the pipeline 1 for delivering fluid into the hole from the surface, the diameter of the ball being smaller than the inside diameter of the pipeline 1 and larger than that of the flushing port 19 of the drilling bit 14. The metal ball 13 easily moves through the pipeline 1 to block the inlet to the flushing port 19 of the drilling bit 14.

This prevents water leakage through the flushing port 19 of the drilling bit 14 in the process of hydraulic mining.

With the drilling bit 14 rotating, torques are imparted to the drilling bit 14 through the pipeline 1 for delivering fluid into the hole positioned along the axis of rotation. The shell of the pipeline 1 is imparted torques, thereby increasing force transmitted to the drilling bit 14.

The present invention, once realized, decreases power expenditure, increases hydraulic mining efficiency, and extends the service life of the device.

What is claimed is:

1. A device for borehole hydraulic mining, comprising:

a pipeline for delivering fluid into a borehole having a surface through which material can be delivered and removed, said pipeline for delivering fluid into the borehole having a side wall, upper and lower ends, and at least one port, provided in said side wall of said pipeline for delivering fluid into the borehole, said pipeline for delivering fluid into the borehole having a constant inside diameter along the entire length thereof;

a pipeline for bringing pulp to the surface having upper and lower ends, said pipeline for delivering fluids into the borehole being positioned concentrically within said pipeline for bringing pulp to the surface;

at least one hydraulic jet secured to and hydraulically communicating with said pipeline for delivering fluid into the borehole;

a hydraulic elevator comprising a fluid and pulp mixing chamber and a nozzle, said fluid and pulp mixing chamber having a cylindrical wall with exterior and interior surfaces and said chamber being secured to said lower end of said pipeline for bringing pulp to the surface, being positioned coaxially with said pipeline for raising pulp to the surface and said pipeline for delivering fluid into the borehole, and enclosing said pipeline for delivering fluid into the borehole with a first annular clearance (11), said nozzle of said hydraulic elevator having an inner space, being secured to said lower end of said pipeline for delivering fluid into the borehole and being spaced from said fluid and pulp mixing chamber of said hydraulic elevator, said nozzle being positioned coaxially with said fluid and pulp mixing chamber, and enclosing said pipeline for delivering fluid into the borehole with a second annular clearance (10), said inner space of said nozzle hydraulically communicating with said pipeline for delivering fluid into the borehole through said at least one port.

2. A device as claimed in claim 1, wherein the inner surface of said cylindrical wall of said fluid and pulp mixing chamber of said hydraulic elevator is made of wear-resistant material.

3. A device as claimed in claim 2, wherein said fluid and pulp mixing chamber of said hydraulic elevator is removably secured to said lower end of said pipeline for bringing pulp to the surface.

4. A device as claimed in claim 1, wherein said fluid and pulp mixing chamber of said hydraulic elevator is removably secured to said lower end of said pipeline for bringing pulp to the surface.

* * * * *